US011473549B2

(12) United States Patent
Nakamura et al.

(10) Patent No.: US 11,473,549 B2
(45) Date of Patent: Oct. 18, 2022

(54) IGNITION APPARATUS

(71) Applicant: Mitsubishi Electric Corporation, Tokyo (JP)

(72) Inventors: Toshifumi Nakamura, Tokyo (JP); Takahiko Inada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/210,605

(22) Filed: Mar. 24, 2021

(65) Prior Publication Data

US 2021/0388806 A1 Dec. 16, 2021

(30) Foreign Application Priority Data

Jun. 12, 2020 (JP) ..... JP2020-102035

(51) Int. Cl.
*F02P 3/055* (2006.01)
*F02P 7/077* (2006.01)
*F02P 17/12* (2006.01)

(52) U.S. Cl.
CPC ..... *F02P 3/0554* (2013.01); *F02P 7/077* (2013.01); *F02P 17/12* (2013.01)

(58) Field of Classification Search
CPC ..... F02P 3/053; F02P 3/055; F02P 3/0552; F02P 3/0554; F02P 7/077; F02P 17/12; F02P 2017/121
See application file for complete search history.

(56) References Cited

U.S. PATENT DOCUMENTS 4,892,080 A * 1/1990 Morino ..... F02P 3/096 123/604
5,056,496 A * 10/1991 Morino ..... F02P 3/0884 123/608

(Continued)

FOREIGN PATENT DOCUMENTS

JP 1-130060 A 5/1989
JP 2-87971 U 7/1990

(Continued)

OTHER PUBLICATIONS

Communication dated Jun. 29, 2021 from the Japanese Patent Office in Application No. 2020-102035.

*Primary Examiner* — John M Zaleskas
(74) *Attorney, Agent, or Firm* — Sughrue Mion, PLLC; Richard C. Turner

(57) ABSTRACT

An object is to reduce the required numbers of connector pins and A/D converters, without degrading the detection accuracy. There is provided an ignition apparatus which includes: ignition plugs provided for multiple cylinders; an ignition coil provided for each cylinder, and having a primary coil and a secondary coil magnetically coupled to the primary coil and connected to the ignition plug; switching devices each for switching between application and shut-off of current to the primary coil; a primary-voltage-signal separator provided for each cylinder, for inputting thereto a voltage of the primary coil and outputting the voltage as a primary signal; a primary-signal combiner for electrically combining together each primary signal corresponding to each cylinder, to thereby output a composite primary signal; and a primary-voltage-information detector for inputting thereto the composite primary signal, to thereby output primary voltage information of each cylinder.

11 Claims, 11 Drawing Sheets

(56) References Cited

U.S. PATENT DOCUMENTS

| | | | | | |
|---|---|---|---|---|---|
| 5,446,385 | A * | 8/1995 | Kugler | F02P 3/0554 | 315/209 T |
| 5,692,484 | A * | 12/1997 | Downey | F02P 15/08 | 123/643 |
| 6,100,701 | A * | 8/2000 | Hoy | F02P 11/06 | 324/537 |
| 6,679,237 | B1 * | 1/2004 | Skinner | F02P 7/035 | 123/643 |
| 2008/0278884 | A1 * | 11/2008 | Skinner | H01F 38/12 | 361/263 |
| 2009/0260607 | A1 * | 10/2009 | LaDuke | F02P 9/002 | 123/609 |
| 2012/0017881 | A1 * | 1/2012 | Kataoka | F02P 3/04 | 123/621 |
| 2012/0186569 | A1 * | 7/2012 | Shimakawa | F02P 15/10 | 123/644 |
| 2013/0241429 | A1 * | 9/2013 | Ruan | F02P 3/045 | 315/213 |
| 2016/0084214 | A1 * | 3/2016 | Okuda | F02P 15/006 | 123/604 |
| 2019/0113017 | A1 * | 4/2019 | Nakamura | F02P 3/053 | |
| 2020/0318599 | A1 * | 10/2020 | Nakamura | F02P 3/0435 | |
| 2021/0222665 | A1 * | 7/2021 | Nakamura | F02P 15/10 | |

FOREIGN PATENT DOCUMENTS

| | | | |
|---|---|---|---|
| JP | 7-243370 | A | 9/1995 |
| JP | 2016-065462 | A | 4/2016 |
| WO | WO-9203655 | A1 * | 3/1992 |

* cited by examiner

IGNITION APPARATUS

BACKGROUND OF THE INVENTION

1. Field of the Invention

The present application relates to an ignition apparatus.

2. Description of the Background Art

In spark-ignition type internal combustion engines, in many cases, an air-fuel mixture in the combustion chamber is combusted in such a manner that a current is applied to a primary coil and is then shut off, thereby to induce a secondary voltage in a secondary coil magnetically coupled thereto and then to generate a high-voltage arc in the ignition plug provided in the combustion chamber and connected to the secondary coil.

There is proposed a method in which a breakdown voltage of the ignition plug on that occasion is measured and used for controlling the internal combustion engine. The breakdown voltage is a secondary voltage induced on the secondary-coil side of the ignition coil, at the moment when breakdown occurs between the electrodes of the ignition plug. The behavior of the secondary voltage is correlated with the length of a discharging path of the high-voltage arc and the worn state of the plug. From information related to the secondary voltage, information related to the inside of the cylinder in the internal combustion engine can be obtained, which is usable for controlling the internal combustion engine. With respect to conventional ignition apparatuses for the internal combustion engines, in order to measure the secondary voltage, there is proposed a method in which the breakdown voltage is measured indirectly based on a voltage generated an the primary-coil side (hereinafter, referred to as a primary voltage) of the ignition coil (for example, Patent Document 1).

Patent Document 1: Japanese Patent Application Laid-open No. 2016-65462

According to the technique described in Patent Document 1, the voltage of the primary coil is detected for each set of the ignition plug, the primary coil and the secondary coil, which is disposed for each of the cylinders of the spark-ignition type internal combustion engine, to thereby detect abnormal discharge or misfire of the ignition plug. However, in the internal combustion engine having the multiple cylinders, it is required to dispose a circuit for detecting the voltage of the primary coil, individually for each of the cylinders. In order to do so, circuits are necessary which include comparators, A/D converters, etc. and the number of which corresponds to that of the cylinders of the internal combustion engine.

This may cause increase in size, weight or cost of the ignition apparatus.

In order to properly control the operation state of the internal combustion engine, a variety of sensors, such as, a crank angle sensor, a cam angle sensor, an intake amount detection sensor, a water temperature sensor, a power-supply voltage sensor, etc., and a variety of switches, are connected to that engine. Analog voltage signals outputted from the variety of sensors are converted, using A/D converters, into digital signals, and the thus-converted digital signals are arithmetically processed by an EC (Electronic Controller). It can be called as an ECU (Electronic Control Unit). Recently, for the purposes of emission control and fuel economy improvement, the number of the variety of sensors and actuators to be mounted on the internal combustion engine tends to increase. Thus, addition of processing circuits and A/D converters for the purpose of measuring the voltages of the primary coils, which is matched to the number of the cylinders of the internal combustion engine, results in further increase in size, weight or cost of a controller that includes the ignition apparatus of the internal combustion engine, and is thus problematic.

The numbers of connector pins and A/D converters to be connected to the ECU cannot be increased limitlessly because these numbers are restricted by the size of the ECU housing and the manufacturing cost. An additional installation of the connection pin and the A/D converter for detection of the primary voltage may result in upsizing of the ECU housing and manufacturing-cost increase.

SUMMARY OF THE INVENTION

An object of this application is reduce, in an internal combustion engine having multiple cylinders, the required numbers of the connector pins and the A/C converters to be connected to the ECU, without degrading the detection accuracy of the primary voltages outputted by the ignition coils for the respective cylinders, and thus to provide an ignition apparatus which is contributory to reduction in its size, weight or cost.

An ignition apparatus according to this application comprises:

an ignition plug provided for each of multiple cylinders of an internal combustion engine;

an ignition coil provided for each of the cylinders, and having a primary coil and a secondary coil that is magnetically coupled to the primary coil and connected to the ignition plug;

a switching device provided for each of the cylinders, for switching between application and shut-off of current to the primary coil;

a primary-voltage-signal separator provided for each of the cylinders, for inputting thereto a voltage of the primary coil and outputting that voltage as a primary signal;

a primary-signal combiner for electrically combining together each said primary signal corresponding to each of the cylinders, to thereby output a composite primary signal; and a primary-voltage-information detector for inputting thereto the composite primary signal, to thereby output primary voltage information of each of the cylinders.

In accordance with the ignition apparatus according to this application, in an internal combustion engine having multiple cylinders, the required numbers of the connector pins and the A/D converters to be connected to the ECU can be reduced without degrading the detection accuracy of the primary voltages outputted by the ignition coils for the respective cylinders, and this can contribute to reduction in size, weight or cost of the ignition apparatus.

DETAILED DESCRIPTION OF THE EMBODIMENTS OF THE INVENTION

Hereinafter, embodiments will be described with reference to the drawings.

1. Embodiment 1

<Configuration of Ignition Apparatus>

Figure 1:
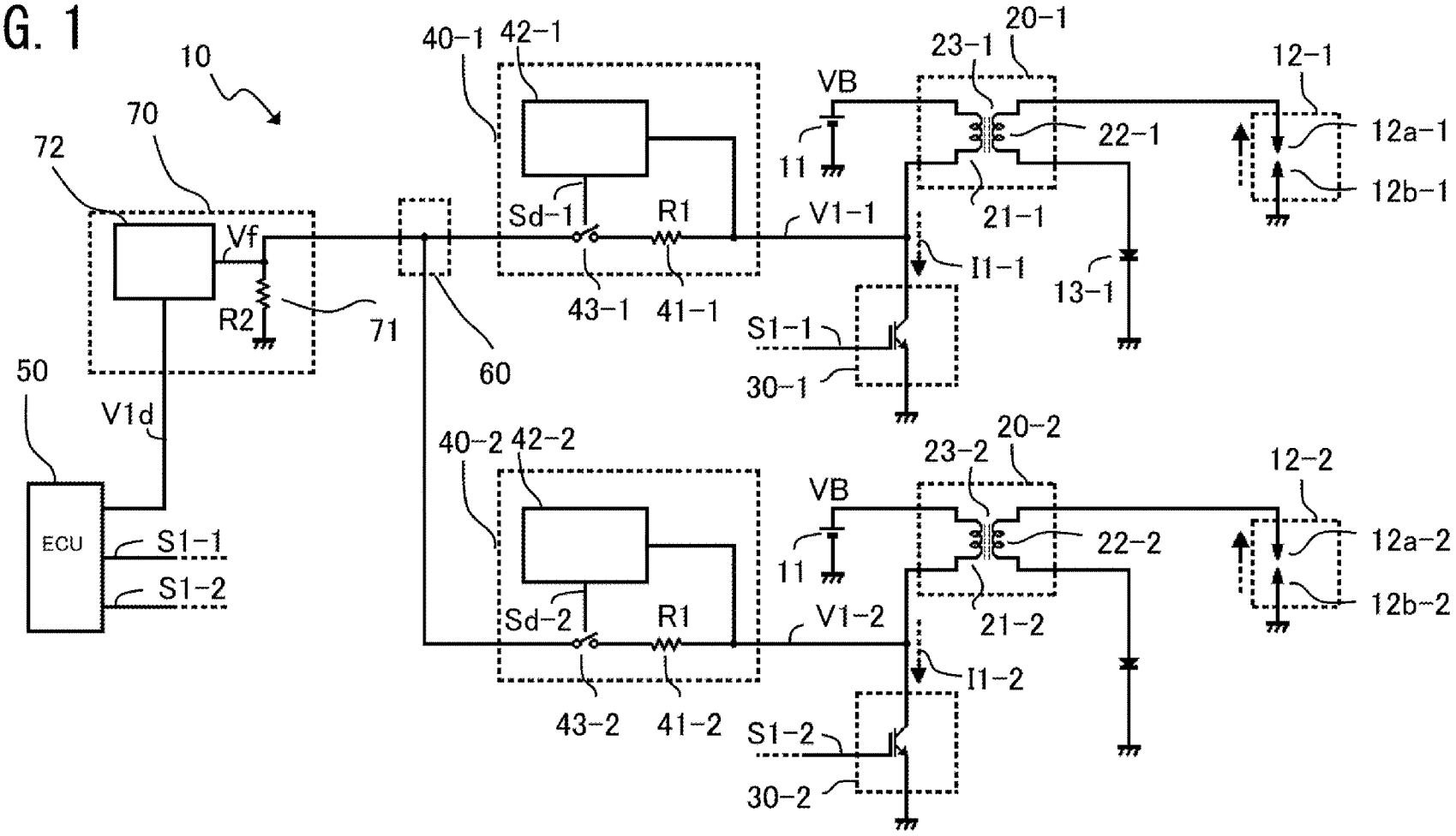
FIG. 1 is a configuration diagram showing an ignition apparatus according to Embodiment 1.

FIG. 1 is a configuration diagram showing an ignition apparatus for an internal combustion engine, according to Embodiment 1. In the description of this embodiment, for simplification's sake, a configuration of a two-cylinder internal combustion engine is employed; however, this is not imitative and the invention is applicable to an internal combustion engine provided with more than two cylinders.

As shown in FIG. 1, an ignition apparatus 10 includes: a controller 50; a primary-signal combiner 60; a primary-voltage-information detector 70; an ignition coil 20-1, a switching device 30-1 and a primary-voltage-signal separator 40-1 that are related to the first cylinder; and a switching device 30-2, an ignition coil 20-2 and a primary-voltage-signal separator 40-2 that are related to the second cylinder.

In the figures, numbers "-1" and "-2" suffixed to the reference numerals given to specific configuration elements indicate the respective cylinder numbers. For example, the symbol "20-1" indicates the ignition coil for the first cylinder, and the symbol "20-2" indicates the ignition coil for the second cylinder. In some instances, the configuration elements for the first cylinder will be described as representatives and thus the configuration elements for the second cylinder will be omitted from description.

In the following, the configuration elements related to the first cylinder will be described as representatives. The ignition coil 20-1 has a primary coil 21-1, a secondary coil 22-1 and a core 23-1. The primary coil 21-1 is wound around the core 23-1.

A high-voltage side terminal of the primary coil 21-1 is connected to the positive electrode terminal of a DC power supply 11. A negative electrode terminal of the DC power supply 11 is grounded. As the DC power supply 11, for example, a lead storage battery is used.

The DC power supply 11 outputs a rated power supply voltage of 12V. Power is supplied to the primary coil 21-1 from the DC power supply 11. A low-voltage side terminal of the primary coil 21-1 is connected to the ground through the switching device 30-1. The switching device 30-1 is, for example, an IGBT (Insulated Gate Bipolar Transistor). The switching device 30-1 switches a state about the application of current to the primary coil 21-1, between ON state and OFF state.

The secondary coil 22-1 is wound around the core 23-1. Thus, the secondary coil 22-1 is magnetically coupled to the primary coil 21-1 by way of the core 23-1. The number of turns N2 of the secondary coil 22-1 is more than the number of turns N1 of the primary coil 21-1. The turn ratio RN12 of the secondary coil 22-1 relative to the primary coil 21-1 is N2/N1 (N1, N2 and RN12 are not illustrated).

A high-voltage side terminal of the secondary coil 22-1 is connected to a first electrode 12*a*-1 of an ignition plug 12-1. A low-voltage side terminal of the secondary coil 22-1 is connected to an anode of a reverse-flow prevention diode 13-1. A cathode of the reverse-flow prevention diode 13-1 is connected to the around. Thus, the reverse-flow prevention diode 13-1 prevents a current from flowing from the ground toward the secondary coil 22-1, while allowing a current flowing from the secondary coil 22-1 toward the ground to pass therethrough.

The core 23-1 stores magnetic energy generated by the application of current to the primary coil 21-1. The secondary coil 22-1 supplies power based on the magnetic energy stored in the core 23-1, to the ignition plug 12-1.

The ignition coil 12-1 has the first electrode 12*a*-1 and a second electrode 12*b*-1. The first electrode 12*a*-1 and the second electrode 12*b*-1 are opposed to each other with an interval therebetween. The ignition plug 12-1 is provided in the internal combustion engine so that the first electrode 12*a*-1 and the second electrode 12*b*-1 are exposed inside the combustion chamber of she internal combustion engine. The ignition plug 12-1 is used for igniting the combustible air-fuel mixture. The combustible air-fuel mixture is produced in the combustion chamber.

The primary-voltage-signal separator 40-1 includes a high-voltage side resistance 41-1, a signal switching device 43-1 and a primary-voltage-signal controller 42-1. A sensing terminal of the primary-voltage-signal controller 42-1 is connected so as to be able to detect a primary voltage V1-1.

Based on a generation level of the primary voltage V1-1, the primary-voltage-signal controller 42-1 outputs a switching signal Sd-1 for controlling the signal switching device 43-1. The primary voltage V1-1 is a voltage generated at a coil terminal of the primary coil 21-1 that is opposite to a coil terminal thereof connected to the DC power supply 11.

The signal switching device 43-1 is, for example, a MOS-FET. The signal switching device 43-1 sets a state about the conduction between the high-voltage side resistance 41-1 and the primary-signal combiner 60, to either ON state or OFF state.

During a period where the generation level of the primary voltage V1-1 is more than a predetermined primary-voltage threshold value, the primary-voltage-signal controller 42-1 controls the signal switching device 43-1 to be set to ON state. The primary-voltage threshold value is set higher than the power supply voltage outputted by the DC power supply 11. By thus setting the primary-voltage threshold value, it is possible to transmit only a meaningful primary voltage V1-1, as the primary signal, to the primary-signal combiner 60. The primary-voltage threshold value may be set arbitrarily. However, when the switching device 30-1 is being turned off, the voltage of the DC power supply 11 is steadily outputted as the primary voltage V1-1 and thus, it is desired that the primary-voltage threshold value be set to a value higher than the voltage of the DC power supply 11.

One end of the high-voltage side resistance 41-1 is connected to the low-voltage side terminal of the primary coil 21-1. The other end of the high-voltage side resistance 41-1 is connected to the signal switching device 43-1. Because of the combination of the high-voltage side resistance 41-1 with a low-voltage side resistance 71 of the primary-voltage information detector 70, a voltage-dividing resistance circuit is formed. This makes it possible to cause the primary voltage be inputted after being converted into a voltage in a range that is easily processable by the primary-voltage-information detector 70.

The primary-signal combiner 60 placed between the primary-voltage-signal separator 40-1 and the primary-voltage-information detector 70. In the primary signal combiner 60, each output signal line from the primary-voltage-signal separator 40-1 corresponding to each of the cylinders, connected, via an electrical contact, with an input signal line of the primary-voltage-information detector 70. Such a method using soldering, solderless terminal or the like, is conceivable for the formation of the electrical contact; however, a method therefor is not particularly limited so long as the respective signal lines are in a mutually electrically conductive state.

Using the switching device 30-1, the controller 50 sets a state about the application of current to the primary coil 21-1, to either ON state or OFF state. The controller 50 transmits a command signal S1-1 to the gate terminal of the switching device 30-1 for one of the respective cylinders. The command signal S1-1 is a signal having a binary value of High level or Low level.

When the High-level command signal S1-1 is inputted to the gate terminal of the switching device 30-1, the state about the application of current to the primary coil 21-1 is set to ON state. When the Low-command signal S1-1 is inputted to the gate terminal of the switching device 30-1, the state about the application of current to the primary coil 21-1 is set to OFF state.

When the state about the application of current to the primary coil 21-1 is set to ON state by the controller 50, a primary current I1-1 flows through the primary coil 21-1, so that power s supplied from the DC power supply 11 to the primary coil 21-1. When the state about the application of current to the primary coil 21-1 is set to OFF state by the controller 50, the primary current I1-1 is shut off. Namely, the supply of power from the DC power supply 11 to the primary coil 21-1 is suspended.

The primary-voltage-information detector 70 includes a primary-voltage converter 72 and the low-voltage side resistance 71. One end of the low-voltage side resistance 71 is connected to the primary-signal combiner 60. The other end of the low-voltage side resistance 71 is connected to the ground.

The primary-voltage converter 72 reads out a detection voltage Vf divided by the voltage-dividing circuit formed by the high-voltage side resistance 41-1 and the low-voltage side resistance 71, and then performs calculation, to thereby output information of the primary voltage V1-1, as primary voltage information V1*d*, to the controller 50. Here, since the resistance value of wiring is generally smaller than that of a resistor, the voltage at the primary-signal combiner 60 is assumed to be the same as the detection voltage Vf, so that description thereof will be omitted.

For example, the relationship between the primary voltage information V1*d* as an output of the primary-voltage converter 72 and the detection voltage Vf is represented by a following formula.

$$V1d=Vf/RR1$$

Here, RR1 (not illustrated) denotes a voltage division ratio, which is calculated by a following formula.

$$RR1=R2/(R1+R2)$$

Here, R1 denotes a resistance value of the high-voltage side resistance (41-1) for each of the cylinders, and R2 denotes a resistance value of the low-voltage side resistance 71. In Embodiment 1, for simplification's sake, the resistance values of the high-voltage side resistance 41-1 for the first cylinder and a high-voltage side resistance 41-2 for the second cylinder are assumed to be the same. In the foregoing, the description has been made about the configuration elements related to the first cylinder; however, since the configuration elements related to the second cylinder are similar to the above, description thereof will be omitted.

<Hardware Configuration of Controller>

Figure 2:
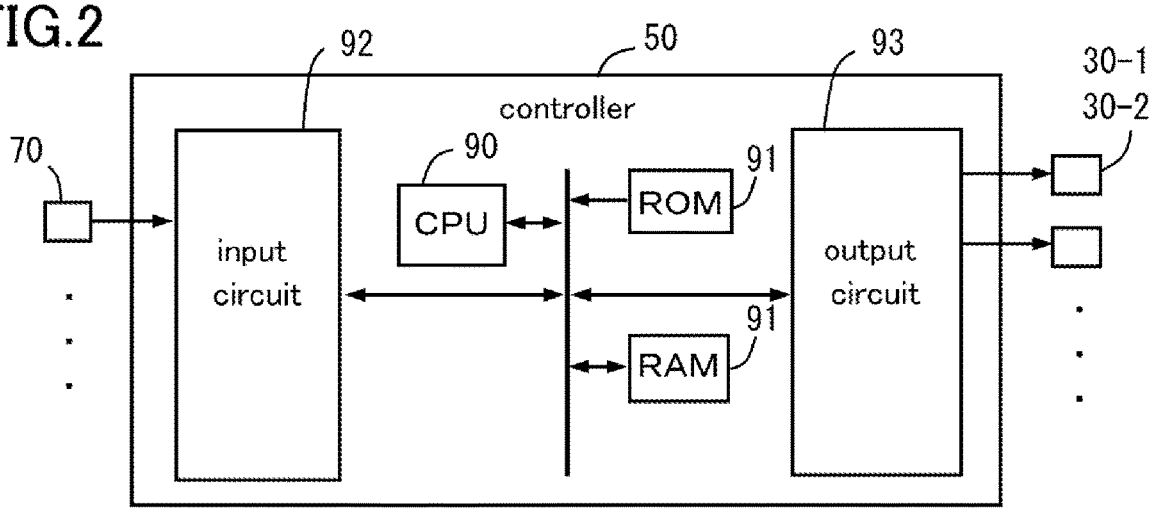
FIG. 2 is a hardware configuration diagram of a controller of the ignition apparatus according to Embodiment 1.

FIG. 2 is a hardware configuration diagram of a processing circuit which implements the respective functions of the controller 50. The functions of the controller 50 may be included in an internal-combustion engine controller for controlling the internal combustion engine depending on the intake amount of the internal combustion engine. Instead, an ignition controller for executing only application control of currents to the ignition coils and monitoring of the primary voltages, may be provided separately from the internal-combustion engine controller. Here, description will be made by citing a case where the controller for the ignition apparatus is included in the internal-combustion engine controller. As shown in FIG. 2, the internal-combustion engine controller includes an arithmetic processing device 90, storage devices 91, an input circuit 92, an output circuit 93, etc.

The arithmetic processing device 90 is, for example, a CPU (Central Processing Unit). The storage device 91 transmits/receives data to/from the arithmetic processing unit 90. The input circuit 99 inputs an external signal to the arithmetic processing unit 90. The output circuit 93 outputs a signal from the arithmetic processing unit 90 to the outside.

Specific Examples of the arithmetic processing device 90 include: an ASIC (Application specific Integrated Circuit), an IC (integrated Circuit), a DSP (Digital Signal Processor), an FPGA (Field Programmable Gate Array), a variety of logic circuits, a variety of signal processing circuits, and the like. In another aspect, the arithmetic processing device 90 may include multiple logic circuits/signal processing circuits of the same type or different types, or the like, so that the respective parts of processing may be executed separately.

In the internal-combustion engine controller, a RAM (Random Access Memory), a ROM (Read Only Memory) and the like, are included as the storage devices 91. The RAM is configured to allow reading and writing of data by the arithmetic processing device 90. The ROM is configured to allow reading of data by the arithmetic processing device 90.

The input circuit 92 is connected to a variety of sensors, such as, a crank angle sensor, a cam angle sensor, an intake amount detection sensor, a water temperature sensor, a power-supply voltage sensor, etc., and a variety of switches. Further, the input circuit 92 is connected to the primary-voltage-information detector 70. The input circuit 92 includes A/D converters.

The A/D converters convert analog signals from the variety of sensors and sensors and from the primary-voltage-information detector 70, into digital signals to be inputted to the arithmetic processing device 90.

The output circuit 93 is connected to electric loads, such as, the switching devices 30-1, 30-2, injectors, etc. The output circuit 93 includes a driver circuit.

The driver circuit outputs control signals from the arithmetic processing device 90 to the electric loads.

The functions provided by the controller 50 are implemented in such a manner that the arithmetic processing device 90 executes programs stored in the storage devices 91, such as a ROM, a RAM and the like, to thereby cooperate with the other hardware, such as the input circuit 92, the output circuit 93, etc.

As basic control processing, the controller makes calculation of a fuel injection amount, an ignition timing and the like, on the basis of the inputted signals from the variety of sensors. Then, the controller 50 controls driving of the switching device 30-1, the injector, etc.

Note that the functions of the internal-combustion engine controller may be implemented partly by dedicated hardware and partly by firmware of a software separate type or firmware of a software integration type.

In this manner, using hardware, software or a combination thereof, the processing circuit can implement the functions of the internal-combustion engine controller.

<Description of Operation of Ignition Apparatus>

Figure 3:
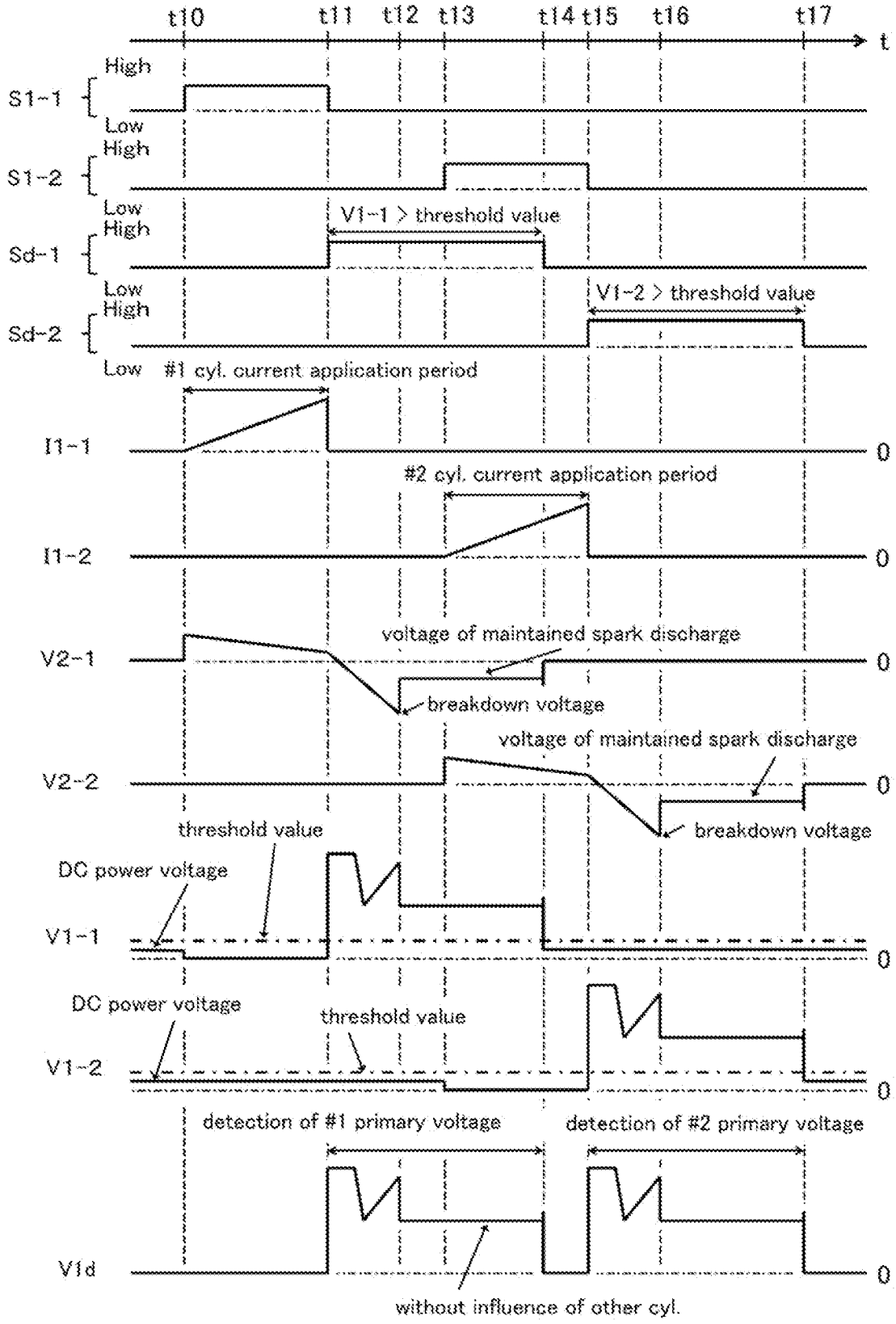
FIG. 3 is a timing chart for illustrating operations of the ignition apparatus according to Embodiment 1.

FIG. 3 is a timing chart for illustrating operations of the ignition apparatus 10 according to Embodiment 1. Upon reaching a specially-determined ignition period, the controller 50 switches, at a time t10, the command signal S1-1 for the switching device 30-1 from Low level to High level. Accordingly, a state about the application of current to the primary coil 21-1 is switched from OFF state to ON state, thus causing the primary current I1-1 to begin flowing through the primary coil 21-1. Then, magnetic energy is stored in the core 23-1.

On this occasion, the primary voltage V1-1 decreases from the power supply voltage outputted the DC power supply 11 to a level of nearly zero.

At a subsequent time t11, the controller 50 switches the command signal S1-1 from High level to Low level. Accordingly, the state about the application of current to the primary coil 21-1 is switched from ON state to OFF state, so that the primary current I1-1 is shut off.

At the time t11, a primary current shut-off noise occurs in the primary voltage V1-1, so that the voltage level is elevated abruptly. The primary-voltage-signal controller 42-1 detects that the primary voltage V1-1 has exceeded the primary-voltage threshold value, to thereby switches the switching signal Sd-1 from Low level to High level. As a result, the signal switching device 43-1 corresponding to the first cylinder is switched roes OFF state to ON state, so that the primary voltage V1-1 for the first cylinder is detected by the primary voltage-information detector 70.

The primary voltage information V1*d* is inputted by the primary-voltage-information detector 70 to the controller 50. At this time, detection of the primary voltage V1-1 for the first cylinder is initiated.

Thereafter, the primary voltage shut-off noise disappears, so that such a voltage level emerges that is proportional to a generated secondary voltage V2-1.

When the secondary voltage V2-1 reaches the breakdown voltage at a time t12, a spark discharge occurs between the electrodes of the ignition plug 12-1.

At a time t13, a command signal S1-2 for the switching device 30-2 is switched from Low level to High level. Accordingly, a state about the application of current to a primary coil 21-2 is switched from OFF state to ON state, thus causing a primary current I1-2 to begin flowing through the primary coil 21-2. Then, magnetic energy is stored in a core 23-2.

On this occasion, a primary voltage V1-2 decreases from the power supply voltage outputted by the DC power supply 11 to a level of nearly zero.

At a time t14, the magnetic energy stored in the ignition coil 20-1 is all consumed, so that the secondary current becomes zero, resulting in termination of the spark discharge. On this occasion, the primary voltage V1-1 decreases from the voltage level during the spark discharge being maintained, to the power supply voltage outputted by the DC power supply 11. Because the primary voltage V1-1 falls below the primary-voltage threshold value, the primary-voltage-signal controller 42-1 switches the switching signal Sd-1 from High level to Low level. As a result, the signal switching device 43-1 is switched from ON state to OFF state, so that the primary voltage information V1*d* is not detected anymore.

At a subsequent time t15, the controller 50 switches the command signal S1-2 from High level to Low level. Accordingly, the state about the application of current to the primary coil 21-2 is switched from ON state to OFF state, so that the primary current I1-2 is shut off. At the time t15, a primary current shut-off noise occurs in the primary voltage V1-2, so that the voltage level is elevated abruptly. When the primary voltage V1-2 exceeds the primary-voltage threshold value, a primary-voltage-signal controller 42-2 switches a switching signal. Sd-2 from Low level to High level. As a result, a signal switching device 43-2 corresponding to the second cylinder is switched from OFF state to ON state, so that the primary voltage V1-2 for the second cylinder is detected as primary voltage information V1*d*. Thereafter, the primary voltage shut-off noise disappears, so that, as the primary voltage V1-2, such a voltage level emerges that is proportional to a negatively-increasing secondary voltage V2-2.

When the secondary voltage V2-2 reaches the breakdown voltage at a time t16, a spark discharge occurs between a first electrode 12*a*-2 and a second electrode 12*b*-2 of an ignition plug 12-2 corresponding to the second cylinder.

At a time t17, the magnetic energy stored in the ignition coil 20-2 is all consumed, so that the secondary current becomes zero, resulting in termination of the spark discharge. On this occasion, the primary voltage V1-2 decreases from the voltage level during e spark discharge being maintained, to the power supply voltage outputted by the DC power supply 11. Because the primary voltage V1-2 falls below the primary-voltage threshold value, the primary-voltage-signal controller 42-2 switches the switching signal Sd-2 from High level to Low level. As a result, the signal switching device 43-2 is switched from ON state to OFF state, so that the primary voltage information grid is not detected anymore.

In this manner, the ignition apparatus 10 according to Embodiment 1 can reduce, in an internal combustion engine having multiple cylinders, the required numbers of the connector pins and the A/D converters to be connected to the ECU, without degrading the detection accuracy of the primary voltages outputted by the ignition coils for the respective cylinders. This can contribute to reduction in size, weight or cost of the ignition apparatus.

The switching devices 30-1, 30-2 and the signal switching devices 43-1, 43-2 are not limited to IGBTs or MOS-FETs, and other switching elements of transistors or the like may be used therefor.

Meanwhile, since the ignition apparatus is mounted very close to the internal combustion engine, there are possibilities: that the voltage division ratio by the configuration of the voltage-dividing resistance circuit varies due to the thermal resistance of the high-voltage side resistance 41-1, 41-2 or the low-voltage side resistance 71; and that breakage or the like of the harness wire occurs due to vibration of the internal combustion engine. Thus, temperature correction may be applied to the output of the primary-voltage-information detector 70 or failure detection may be performed, in such a manner that the temperature of the ignition apparatus is determined from the ambient temperature and cooling water temperature of the internal combustion engine, the operation load and operation history of the internal combustion engine, and the like, to thereby estimate an effect of the temperature on the voltage-dividing resistance circuit. This makes it possible to perform accurate determination of the primary voltage.

For example, it is possible to estimate an effect of the temperature on the voltage-dividing resistance circuit or to estimate a failure, from the generation voltage level of the primary current shut-off noise occurring at the time the state about the application current to the primary coil 21-1, 21-2 is switched from ON state to OFF state, and the primary voltage information V1*d* when the primary voltage is restricted within a specified voltage by a voltage clamp function that the switching device 30-1, 30-2 has. This makes it possible to perform accurate determination of the primary voltage.

With respect to the cylinder for which the primary coil voltage, that emerges after shutting-off of the application of current to the primary coil 21-1, 21-2, is smaller than a shut-off-noise determination value, a failure may be determined, the temperature correction and the failure determination described above may be performed by the primary-voltage-information detector 70, they may be executed by the controller 50.

2. Embodiment 2

<Configuration of Ignition Apparatus>

Next, description will be made about an ignition apparatus for an internal combustion engine, according to Embodiment 2.

Figure 4:
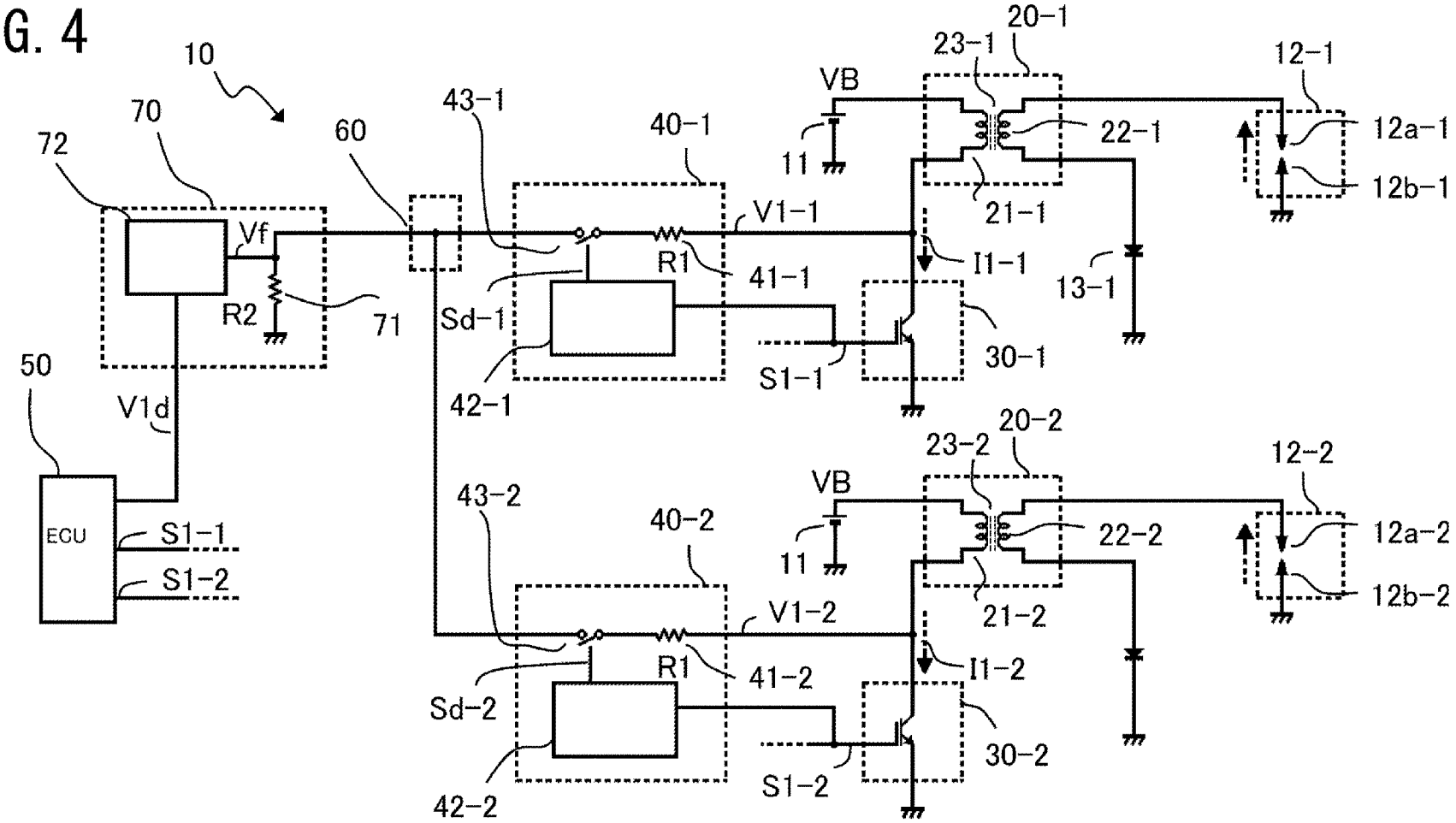
FIG. 4 is a configuration diagram showing an ignition apparatus according to Embodiment 2.

FIG. 4 is a configuration diagram showing the ignition apparatus for an internal combustion engine, according to Embodiment 2. For the configuration elements that are the same as the configuration elements shown in FIG. 1, the same numerals are given, so that detailed description thereof will be omitted.

As shown in FIG. 4, the configuration is the same as that of Embodiment 1 except that the sensing terminals of the primary-voltage-signal controllers 42-1, 42-2 are connected so as to be able to detect the command signal S1-1 and the command signal S1-2.

In the following, the configuration elements related to the first cylinder will be described as representatives. The primary-voltage-signal controller 42-1 controls the signal switching device 43-1 to be set to ON state during a preset fixed period from the time at which the command signal S1-1 for the cylinder concerned is switched from High level to Low level.

Such a period where the signal switching device 43-1 is set to ON state is defined as a primary-voltage detection period Tv1on_dt. At this time, the primary-voltage detection period Tv1on_dt is set to include a generation period of the primary voltage V1-1 in the ignition coil 20-1 for the cylinder concerned.

The primary-voltage detection period Tv1on_dt may be a predetermined fixed period. Instead, it is allowed that a period where the command signal S1-1 is at High level is detected and then, on the basis of that period, the period where the switching device 43-1 is to be set to ON state is determined.

For example, such a method is conceivable in which a map prepared and stored beforehand by simulation, experiment or the like, said map defining the relationship between the period where the command signal S1-1 is at High level, namely, a period during which the magnetic flux is stored in the ignition plug 20-1, and the generation period of the primary voltage V-1. By thus setting the primary-voltage detection period Tv1on_dt, it possible to transmit only a meaningful primary voltage V1-1, as the primary signal, to the primary-signal combiner 60.

In the foregoing, the description has been made about the configuration elements related to the first cylinder; however, since the configuration elements related to the second cylinder are similar to the above, description thereof will be omitted.

<Description of Operation of Ignition Apparatus>

Figure 5:
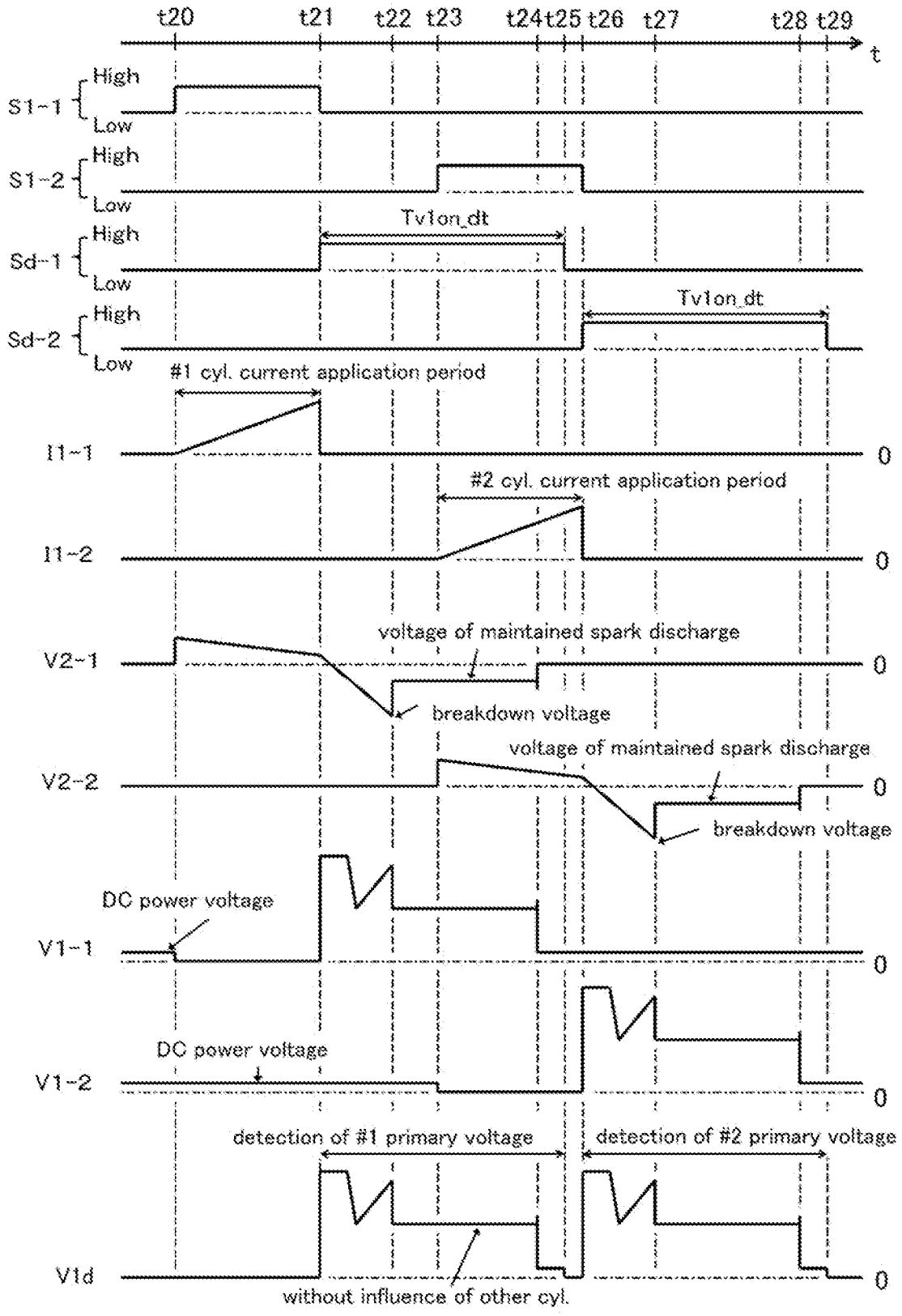
FIG. 5 is a timing chart for illustrating operations of the ignition apparatus according to Embodiment 2.

FIG. 5 is a timing chart for illustrating operations of an ignition apparatus 10 according to Embodiment 1. Upon reaching a specially-determined ignition period, the controller 50 switches, at a time t20, the command signal S1-1 for the switching device 30-1 from Low level to High level. Accordingly, a state about the application of current to the primary coil 21-1 is switched from OFF state to ON state, thus causing the primary current I1-1 to begin flowing through the primary coil 21-1. Then, magnetic energy is stored in the core 23-1. On this occasion, the primary voltage V1-1 decreases from the power supply voltage outputted by the DC power supply 11 to a level of nearly zero.

At a subsequent time t21, the controller 50 switches the command signal S1-1 from High level to Low level. Accordingly, the state about the application of current to the primary coil 21-1 is switched from ON state to OFF state, so that the primary current I1-1 is shut off.

At the time t21, the primary-voltage-signal controller 42-1 detects that the command signal S1-1 is switched from High level to Low level, to thereby switch the switching signal Sd-1 from Low level to High level. As a result, the signal switching device 43-1 corresponding to the first cylinder is switched from OFF state to ON state, so that the primary voltage V1-1 for the first cylinder begins to be detected as the primary voltage information V1*d*, which is then inputted to the controller 50.

Namely, at this time, detection of the primary voltage V1-1 for the first cylinder is initiated.

Thereafter, the primary voltage shut-off noise disappears, so that such a voltage level emerges that is proportional to the generated secondary voltage V2-1.

When the secondary voltage V2-1 reaches the breakdown voltage at a time t22, a spark discharge occurs between the electrodes of the ignition plug 12-1.

At a time t23, the command signal S1-2 for the switching device 30-2 is switched from Low level to High level. Accordingly, a state about the application of current to the primary coil 21-2 is switched from OFF state to ON state, thus causing the primary current I1-2 to begin flowing through the primary coil 21-2. Then, magnetic energy is stored in the core 23-2. On this occasion, the primary voltage V1-2 decreases from the power supply voltage outputted by the DC power supply 11 to a level of nearly zero.

At a time t24, the magnetic energy stored in the ignition coil 20-1 is all consumed, so that the secondary current becomes zero, resulting in termination of the spark discharge. On this occasion, the primary voltage V1-1 decreases from the voltage level during the spark discharge being maintained, to the power supply voltage outputted by the DC power supply 11.

At a time t25, the primary-voltage detection period Tv1on_dt expires, so that the primary-voltage-signal controller 42-1 switches the switching signal Sd-1 from High level to Low level. As a result, the signal switching device 43-1 is switched from ON state to OFF state, so that the detection of the primary voltage V1-1 for the first cylinder is terminated.

At a subsequent time t26, the controller 50 switches the command signal S1-2 from High level to Low level. Accordingly, the state about the application of current to the primary coil 21-2 is switched from ON state to OFF state, so that the primary current I1-2 is shut off.

At the time t26, the primary-voltage-signal controller 42-2 detects that the command signal S1-2 is switched from High level to Low level, to thereby switch the switching signal Sd-2 from Low level to High level. As a result, the signal switching device 43-2 corresponding to the second cylinder is switched from OFF state to ON state, so that the primary voltage V1-2 for the second cylinder begins to be detected as the primary voltage information V1*d*.

Thereafter, the primary voltage shut-off noise disappears, so that such a voltage level emerges that is proportional to the generated secondary voltage V2-2.

When the secondary voltage V2-2 reaches the breakdown voltage at a time t27, a spark discharge occurs between the electrodes of the ignition plug 12-2.

At a time t28, the magnetic energy stored in the ignition coil 20-2 is all consumed, so that the secondary current becomes zero, resulting in termination of the spark discharge. On this occasion, the primary voltage V1-2 decreases from the voltage level during the spark discharge being maintained, to the power supply voltage outputted by the DC power supply 11.

At a time t29, the primary-voltage detection period Tv1on_dt expires, so that the primary-voltage-signal controller 42-2 switches the switching signal Sd-2 from High level to Low level. As a result, the signal switching device 43-2 is switched from ON state to OFF state, so that the detection of the primary voltage V1-2 for the first cylinder is terminated.

In this manner, the ignition apparatus 10 according to Embodiment 2 can reduce, in an internal combustion engine having multiple cylinders, the required numbers of the connector pins and the A/D converters to be connected to the ECU, without degrading the detection accuracy of the primary voltages outputted by the ignition coils for the respective cylinders. This can contribute to reduction in size, weight or cost of the ignition apparatus.

The switching devices 30-1, 30-2 and the signal switching devices 43-1, 43-2 are not limited to IGBTs or MOS-FETs, and other switching elements of transistors or the like may be used therefor.

3. Embodiment 3

<Configuration of Ignition Apparatus>

Next, description will be made about an ignition apparatus for an internal combustion engine, according to Embodiment 3.

Figure 6:
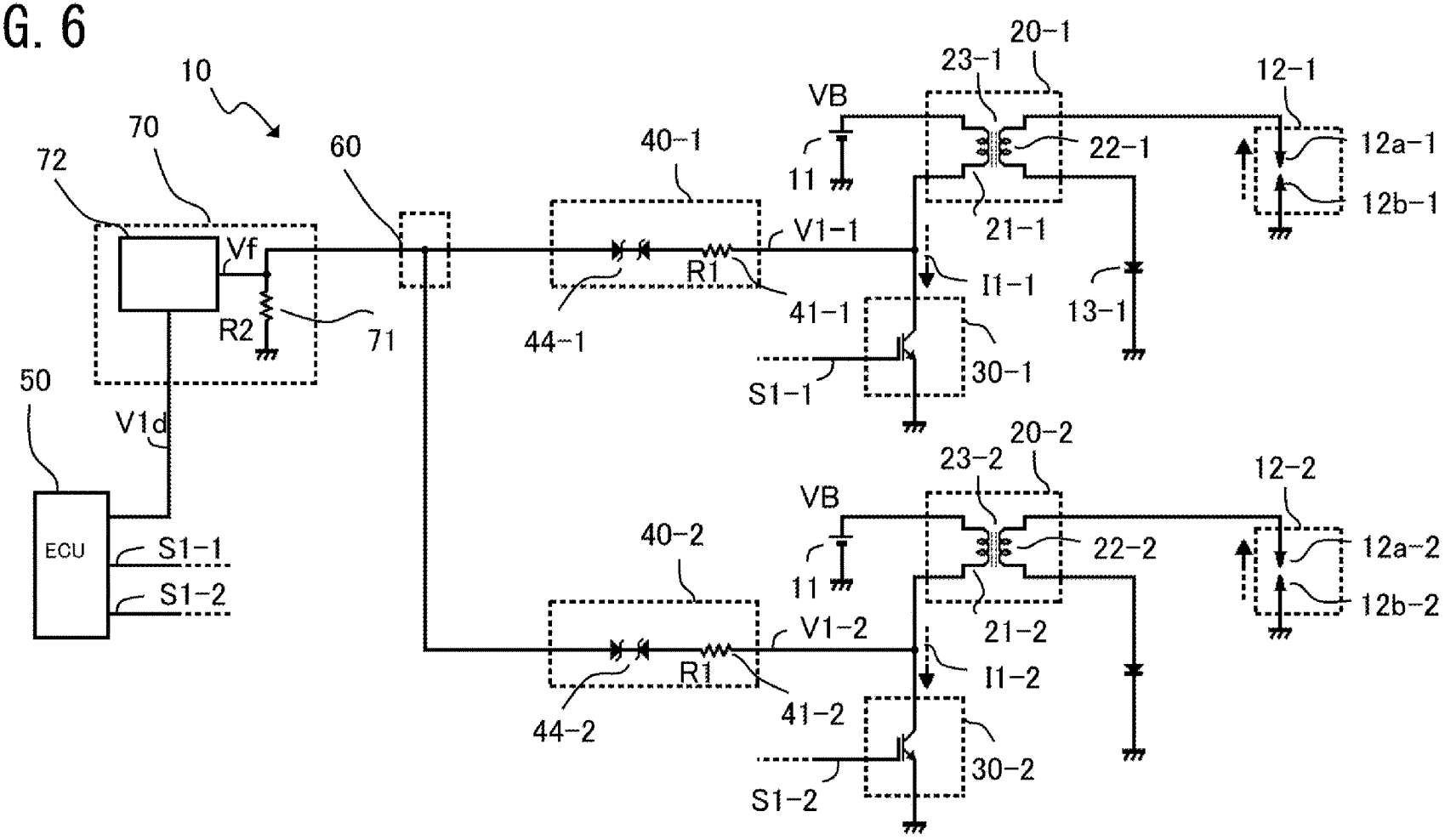
FIG. 6 is a configuration diagram showing an ignition apparatus according to Embodiment 3.

FIG. 6 is a configuration diagram showing the ignition apparatus for an internal combustion engine, according to Embodiment 3. For the configuration elements that are the same as the configuration elements shown in FIG. 1, the same numerals are given, so that detailed description thereof will be omitted.

As shown in FIG. 6, the configuration is the same as that of Embodiment 1 except for the primary-voltage-signal separators 40-1, 40-2.

In Embodiment 3, the primary-voltage-signal separators 40-1, 40-2 are configured with the high-voltage side resistances 41-1, 41-2 and bidirectional Zener diodes 44-1, 44-2, respectively.

In the following, the configuration elements related to the first cylinder will be described as representatives. Because the bidirectional Zener diode 44-1 is placed, in the periods where the generation levels of the primary voltages V1-1, V1-2 for the respective cylinders are each more than a given Zener voltage, a primary voltage solely for the corresponding cylinder is detected. The Zener voltage is set higher than the power supply voltage outputted by the DC power supply 11. By thus setting the Zener voltage, it is possible to transmit only a meaningful primary voltage V1-1, as the primary signal, to the primary-signal combiner 60. The Zener voltage may be set arbitrarily (a Zener diode having a required Zener-voltage characteristic may be selected arbitrarily). However, when the switching device 30-1 is being turned off, the voltage of the DC power supply 11 is steadily outputted as the primary voltage V1-1. Thus, it is desired that the Zener voltage be set to a value higher than the voltage of the DC power supply 11.

One end of the high-voltage side resistance 41-1 is connected to the low-voltage side terminal of the primary coil 21-1. The other end of the high-voltage side resistance 41-1 is connected to the bidirectional Zener diode 44-1. Because of the combination of the high-voltage side resistance 41-1 with the low-voltage side resistance 71 of the primary-voltage-information detector 70, a voltage-dividing resistance circuit is formed.

The bidirectional Zener diode 44-1 only has to be placed between the low-voltage side terminal of the primary coil 21-1 and the primary-signal combiner 60, and the order of connection of the high-voltage side resistance 41-1 and the bidirectional Zener diode 44-1 is not particularly limited. In the foregoing, the description has been made about the configuration elements related to the first cylinder; however, since the configuration elements related to the second cylinder are similar to the above, description thereof will be omitted.

<Description of Operation of Ignition Apparatus>

Figure 7:
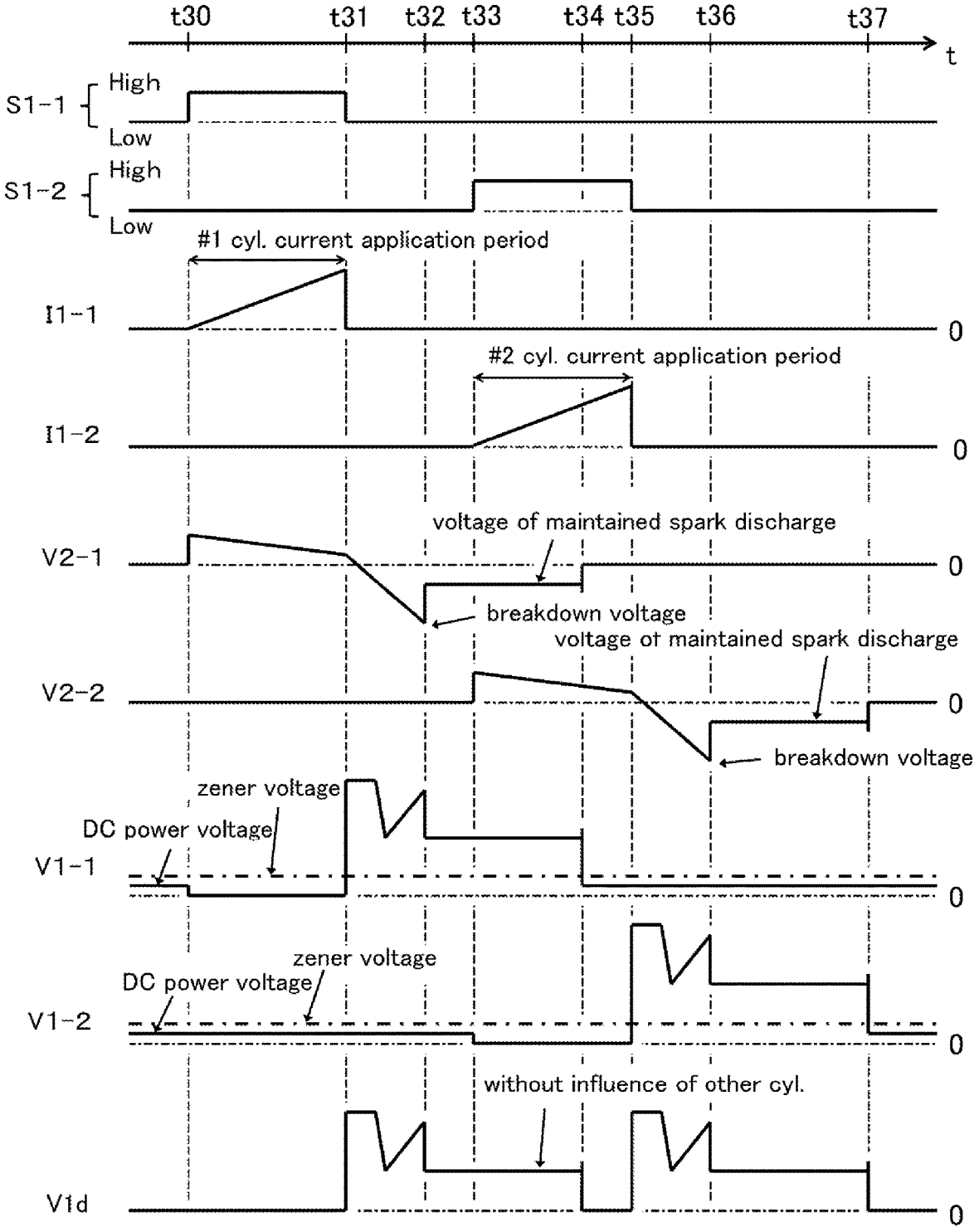
FIG. 7 is a timing chart for illustrating operations of the ignition apparatus according to Embodiment 3.

FIG. 7 is a timing chart for illustrating operations of an ignition apparatus 10 according to Embodiment 3. Upon reaching a specially-determined ignition period, the controller 50 switches, at a time t30, the command signal S1-1 for the switching device 30-1 from Low level to High level. Accordingly, a state about the application of current to the primary coil 21-1 is switched from OFF state to ON state, thus causing the primary current I1-1 to begin flowing through the primary coil 21-1. Then, magnetic energy is stored in the core 23-1. On this occasion, the primary voltage V1-1 decreases from the power supply voltage outputted by the DC power supply 11 to a level of nearly zero.

At a subsequent time t31, the controller 50 switches the command signal S1-1 from High level to Low level. Accordingly, the state of the application of current to the primary coil 21-1 is switched from ON state to OFF state, so that the primary current I1-1 is shut off.

At the time t31, a primary current shut-off noise occurs in the primary voltage V1-1, so that the voltage level is elevated abruptly. When the primary voltage V1-1 exceeds the Zener voltage of the bidirectional Zener diode 44-1, the primary-voltage-signal separator 40-1 is switched from a non-conductive state to a conductive state, so that a voltage that results from deduction of the Zener voltage from the primary voltage V1-1 for the first cylinder, begins to be detected as the primary voltage information V1*d*, which is then inputted to the controller 50.

Thereafter, the primary voltage shut-off noise disappears, so that such a voltage level emerges that is proportional to the generated secondary voltage V2-1.

When the secondary voltage V2-1 reaches the breakdown voltage at a time t32, a spark discharge occurs between the electrodes of the ignition plug 12-1.

At a time t33, the command signal S1-2 for the switching device 30-2 is switched from Low level to High level. Accordingly, a state about the application of current to the primary coil 21-2 switched from OFF state to ON state, thus causing the primary current I1-2 to begin flowing through the primary coil 21-2. Then, magnetic energy is stored in the core 23-2. On this occasion, the primary voltage V1-2 decreases from the power supply voltage of the DC power supply 11 to a level of nearly zero.

At a time t34, the magnetic energy stored in the ignition coil 20-1 is all consumed, so that the secondary current becomes zero, resulting in termination of the spark discharge. On this occasion, the primary voltage V1-1 decreases from the voltage level during the spark discharge being maintained, to the power supply voltage outputted by the DC power supply 11. Because the primary voltage V1-1 falls below the Zener voltage of the bidirectional Zener diode 44-1, the primary-voltage-signal separator 40-1 is switched from a conductive state to a non-conductive state, so that the primary voltage information V1*d* is not detected anymore.

At a subsequent time t35, the controller 50 switches the command signal S1-2 from High level to Low level. Accordingly, the state about the application of current to the primary coil 21-2 is switched from ON state to OFF state, so that the primary current I1-2 is shut off.

At the time t35, a primary current shut-off noise occurs in the primary voltage V1-2, so that the voltage level is elevated abruptly. When the primary voltage V1-2 exceeds the Zener voltage of the bidirectional Zener diode 44-2, the primary-voltage-signal separator 40-2 is switched from a non-conductive state to a conductive state, so that a voltage that results from deduction of the Zener voltage from the primary voltage V1-2 for the second cylinder, begins to be detected as the primary voltage information V1*d*.

Thereafter, the primary voltage shut-off noise disappears, so that such a voltage level emerges that is proportional to the generated secondary voltage V2-2.

When the secondary voltage V2-2 reaches the breakdown voltage at a time t36, a spark discharge occurs between the electrodes of the ignition plug 12-2.

At a time t37, the magnetic energy stored in the ignition coil 20-2 is all consumed, so that the secondary current becomes zero, resulting in termination of the spark discharge. On this occasion, the primary voltage V1-2 decreases from the voltage level during the spark discharge being maintained, to the power supply voltage outputted by the DC power supply 11. Because the primary voltage V1-2 falls below the Zener voltage of the bidirectional Zener diode 44-2, the primary-voltage-signal separator 40-2 is switched from a conductive state to a non-conductive state, so that the primary voltage information V1*d* is not detected anymore.

In this manner, the ignition apparatus 10 according to Embodiment 3 can reduce, in an internal combustion engine having multiple cylinders, the required numbers of the connector pins and the A/D converters to be connected to the ECU, without degrading the detection accuracy of the primary voltages outputted by the ignition coils for the respective cylinders. This can contribute to reduction in size, weight or cost of the ignition apparatus.

The switching devices 30-1, 30-2 are not limited to IGBTs or MOS-FETs, and other switching elements of transistors or the like may be used therefor.

4. Embodiment 4

<Configuration of Ignition Apparatus>

Figure 8:
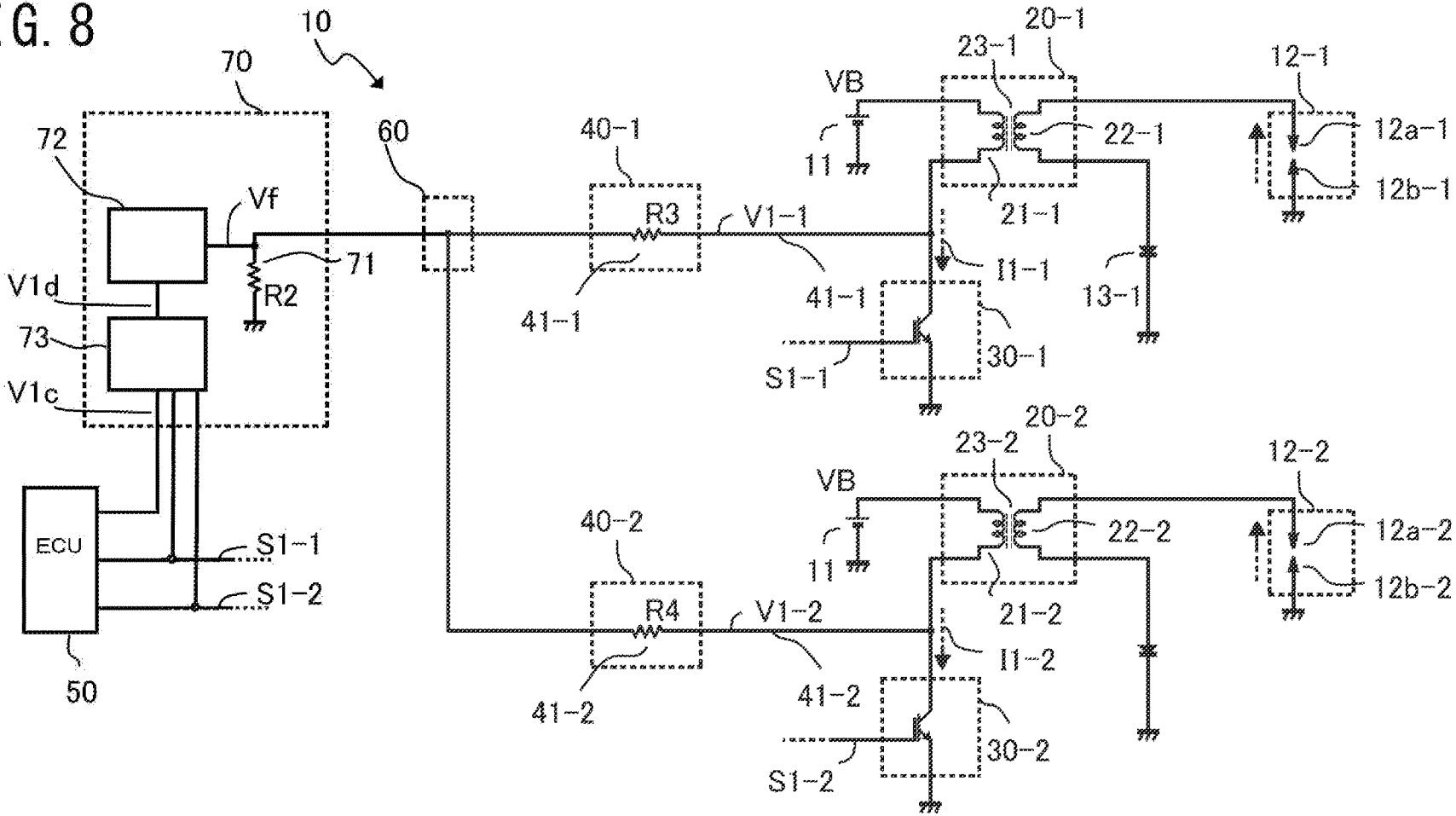
FIG. 8 is a configuration diagram showing an ignition apparatus according to Embodiment 4.

FIG. 8 is a configuration diagram showing an ignition apparatus for an internal combustion engine, according to Embodiment 4. For the configuration elements that are the same as the configuration elements shown in FIG. 1, the same numerals are given, so that detailed description thereof will be omitted.

As shown in FIG. 8, the configuration is the same as that of Embodiment 1 except for the primary-voltage-signal separators 40-1, 40-2 and the primary-voltage-information detector 70.

In Embodiment 4, the primary-voltage-signal separators 40-1, 40-2 have a configuration in which the primary-voltage-signal controllers 42-1, 42-2 and the signal switching devices 43-1, 43-2 are eliminated, namely, they are configured only with the high-voltage side resistances 41-1, 41-2, and are thus simplified. It is appropriate that their resistance values are each set to a large value that is less influenced by another cylinder. For example, its level is from several tens to several hundreds Ω.

However, in Embodiment 4, the signals for the respective cylinders are not fully separated from each other, so that, the primary voltage for the cylinder concerned is subject to influence by an operation such as current application to the primary coil for another cylinder, namely, it is subject to no-small interference by the primary voltage V1-1, V1-2 for another cylinder. Thus, a detection error of the primary voltage becomes larger.

Thus, in Embodiment 4, a primary-voltage corrector 73 is added in the primary-voltage-information detector 70, to thereby ensure functions equivalent to those in Embodiment 1 in which the primary-voltage-signal controllers 42-1, 42-2 and the signal switching devices 43-1, 43-2 are included.

In the following, the configuration elements related to the first cylinder will be described as representatives. When, during the detection of the primary voltage V1-1, the application of current to the primary coil 21-1 for another cylinder is initiated, the primary-voltage corrector 73 corrects the primary voltage information V1*d* of the primary-voltage converter 72 that emerges during a period where the application of current overlaps with that detection, by a primary-voltage correction amount ΔV1*c*. Primary voltage information V1*c* after correction is then outputted from the primary-voltage corrector 73.

Hereinafter, such a state in which current is applied to the primary coil 21-1 for another cylinder during the detection of the primary voltage V1-1, is referred to as "current-application overlap".

For example, a relationship between the primary voltage information V1*d* and the detection voltage Vf at a time when current-application overlap does not occur during the detection of the primary voltage V1-1 for the first cylinder, is represented by a following formula.

$$V1d=(Vf*(R3*R4+R3*R2+R2*R4)-VB*(R3*R2))/(R2*R4)$$

Here, R3 denotes a resistance value of the high-voltage side resistance 41-1 for the first cylinder, R4 denotes a resistance value of the high-voltage side resistance 41-2 for the second cylinder, and R2 denotes a resistance value of the low-voltage side resistance 71.

VB denotes a power supply voltage of the DC power supply 11.

For example, a relationship between the primary voltage information V1*c* after correction and the detection voltage Vf at a time when current-application overlap occurs during the detection of the primary voltage V1-1 for the first cylinder, is represented by a following formula.

$$V1c=(Vf*(R3*R4+R3*R2+R2*R4)-VCE*(R3*R2))/(R2*R4)$$

Here, VCE denotes a voltage drop at the time the switching device 30-2 for the second cylinder is in ON state. (VCE is not illustrated)

Accordingly, the primary-voltage correction amount. ΔV1*c* required at a time when current-application overlap occurs during the detection of the primary voltage V1-1 for the first cylinder, is calculated according to following formulae.

$$V1c=V1d+\Delta V1c$$

$$\Delta V1c=(VB*R3*R2-VCE*R3*R2)/(R2*R4)$$

When processing for that correction is to be simplified, since VCE is generally as small as about 1 to 2 V relative to VB of about 12V, the primary-voltage correction amount ΔV1*c* may be calculated while assuming that VCE is zero, as shown below.

$$\Delta V1c=VB*R3/R4$$

In the foregoing, the description has been made about the configuration elements related to the first cylinder; however, since the configuration elements related to the second cylinder are similar to the above, description thereof will be omitted.

<Description of Operation of Ignition Apparatus>

Figure 9:
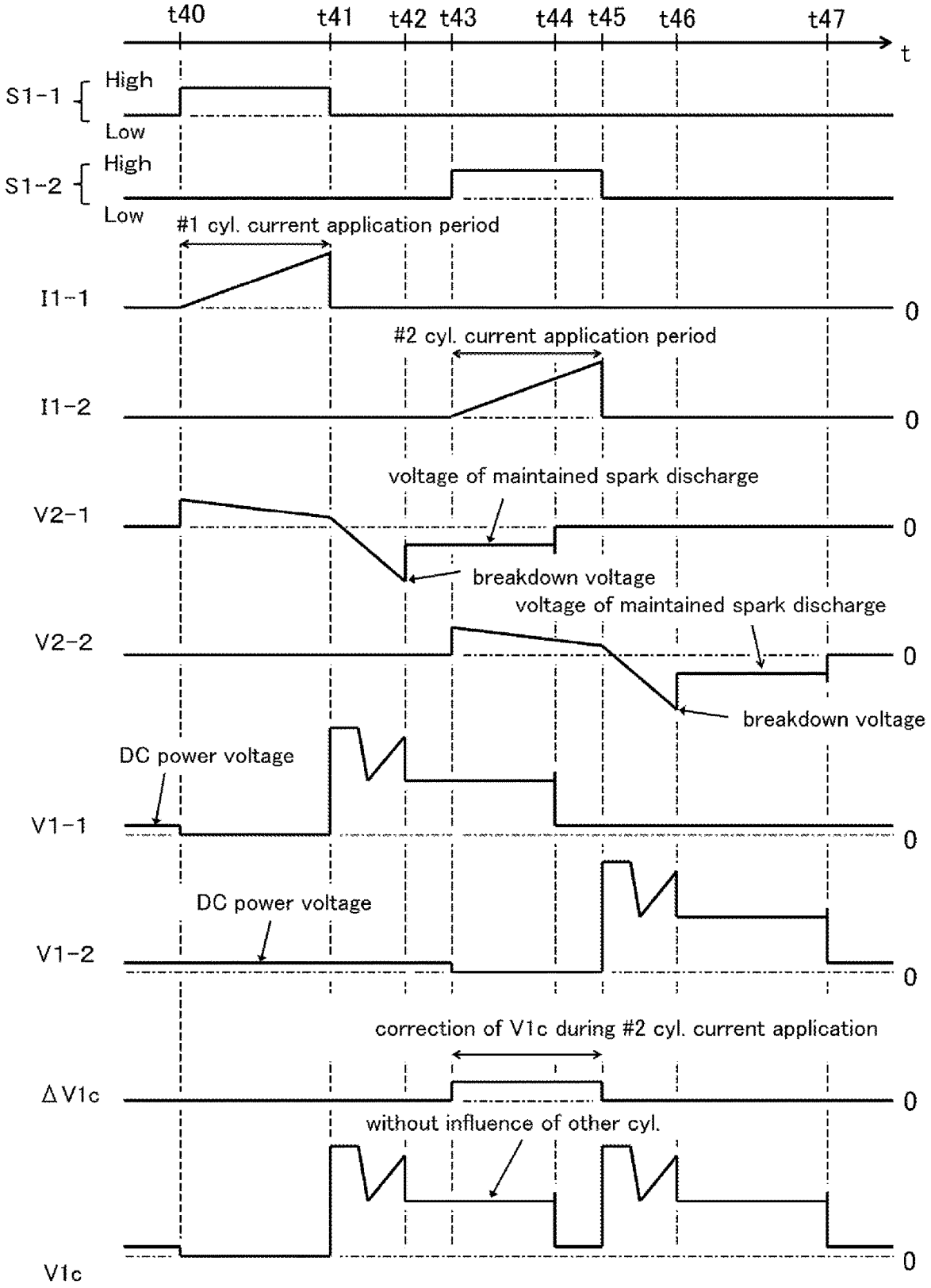
FIG. 9 is a timing chart for illustrating operations of the ignition apparatus according to Embodiment 4.

FIG. 9 is a timing chart for illustrating operations of an ignition apparatus 10 according to Embodiment 4. Upon reaching specially-determined ignition period, the controller 50 switches, at a time t40, the command signal S1-1 for the switching device 30-1 from Low level to High level. Accordingly, state about the application of current to the primary coil 21-1 is switched from OFF state to ON state, thus causing the primary current I1-1 to begin flowing through the primary coil 21-1. Then, magnetic energy stored in the core 23-1. On this occasion, the primary voltage V1-1 decreases from the power supply voltage outputted by the DC power supply 11 to a level of nearly zero.

At a subsequent time t41, the controller 50 switches the command signal 31-1 from High level to Low level. Accordingly, the state about the application of current to the primary coil 21-1 is switched from ON state to OFF state, so that the primary current I1-1 is shut off.

At the time t41, a primary current shut-off noise occurs in the primary voltage V1-1, so that the voltage level is elevated abruptly. The primary voltage V1-1 for the first cylinder begins to be detected as the primary voltage information V1*d*.

At this time, because current-application overlap does not occur, the primary voltage information V1*d* is not corrected by the primary-voltage corrector 73, and is inputted to the controller 50 as it is as primary voltage information V1*c* after correction, namely, detection of the primary voltage V1-1 for the first cylinder is initiated.

Thereafter, the primary voltage shut-off noise disappears, so that such a voltage level emerges that is proportional to the generated secondary voltage V2-1.

When the secondary voltage V2-1 reaches the breakdown voltage at a time t42, a spark discharge occurs between the electrodes of the ignition plug 12-1.

At a time t43, the command signal S1-2 the switching device 30-2 is switched from Low level to High level. Accordingly, a state about the application of current to the primary coil 21-2 is switched from OFF state to ON state, thus causing the primary current I1-2 to begin flowing through the primary coil 21-2. Then, magnetic energy is stored in the core 23-2. On this occasion, the primary voltage V1-2 decreases from the power supply voltage of the DC power supply 11 to a level of nearly zero.

At this time, it is determined that current-application overlap has occurred, so that a correction operation for the primary voltage information V1*d* is initiated by the primary-voltage corrector 73. In the primary-voltage corrector 73, the primary-voltage correction value ΔV1*c* according to a predetermined correction formula is calculated, so that the primary voltage information V1*c* after correction, that results from the correction of the primary voltage information V1*d*, is inputted to the controller 50.

At a time t44, the magnetic energy stored in the ignition coil 20-1 is all consumed, so that the secondary current becomes zero, resulting in termination of the spark discharge. On this occasion, the primary voltage V1-1 decreases from the voltage level during the spark discharge being maintained, to the power supply voltage outputted by the DC power supply 11.

At a subsequent time t45, the controller 50 switches the command signal S1-2 from High level to Low level. Accordingly, the state about the application of current to the primary coil 21-2 is switched from ON state to OFF state, so that the primary current I1-2 is shut off.

At this time, it is determined that the current-application overlap is ended, so that the correction operation for the primary voltage information V1*d* by the primary-voltage corrector 73 is terminated. Thus, the detection of the primary voltage V1-1 for the first cylinder is terminated, and detection of the primary voltage V1-2 for the second cylinder is initiated.

At the time t45, a primary current shut-off noise occurs in the primary voltage V1-2, so that the voltage level is elevated abruptly. The primary voltage V1-2 for the first cylinder begins to be detected as the primary voltage information V1*d*.

Because current-application overlap does not occur, the primary voltage information V1*d* is not corrected by the primary-voltage corrector 73, and is inputted to the controller 50 as it is as primary voltage information Vic after correction.

Thereafter, the primary voltage shut-off noise disappears, so that such a voltage level emerges that is proportional to the generated secondary voltage V2-2.

When the secondary voltage V2-2 reaches the breakdown voltage at a time t46, spark discharge occurs between the electrodes of the ignition plug 12-2.

At a time t47, the magnetic energy stored in the ignition coil 20-2 is all consumed, so that the secondary current becomes zero, resulting in termination of the spark discharge. Then, the detection of the primary voltage V1-2 for the secondary cylinder is terminated.

As described above, according to Embodiment 4, the primary-voltage corrector 73 is added in the primary-voltage-information detector 70, so that the detection accuracy of the primary voltages V1-1, V1-2 becomes equivalent to that according to Embodiment 1 in which the primary-voltage-signal controllers 42-1, 42-2 and the signal switching devices 43-1, 43-2 are included.

In this manner, the ignition apparatus 10 according to Embodiment 4 can reduce, in an internal combustion engine having multiple cylinders, the required numbers of the connector pins and the A/D converters to be connected to the ECU, without degrading the detection accuracy of the primary voltages outputted by the ignition coils for the respective cylinders. This can contribute to reduction in size, weight or cost of the ignition apparatus. In particular, because the primary-voltage-signal separators 40-1, 40-2 are configured solely with the high-voltage side resistances 41-1, 41-2, the circuit configuration is very simple. Further, because the primary voltage information V1*d* is corrected by the primary-voltage corrector 73, the effective primary voltage information V1*c* after correction can be obtained without necessity of the signal switching devices 43-1, 43-2 according to Embodiment 1. Accordingly, it is possible to perform accurate determination of the primary voltage, even during a period where current-application overlap occurs with respect to the primary coils 21-1, 21-2.

5. Embodiment 5

<Configuration of Ignition Apparatus>

Figure 10:
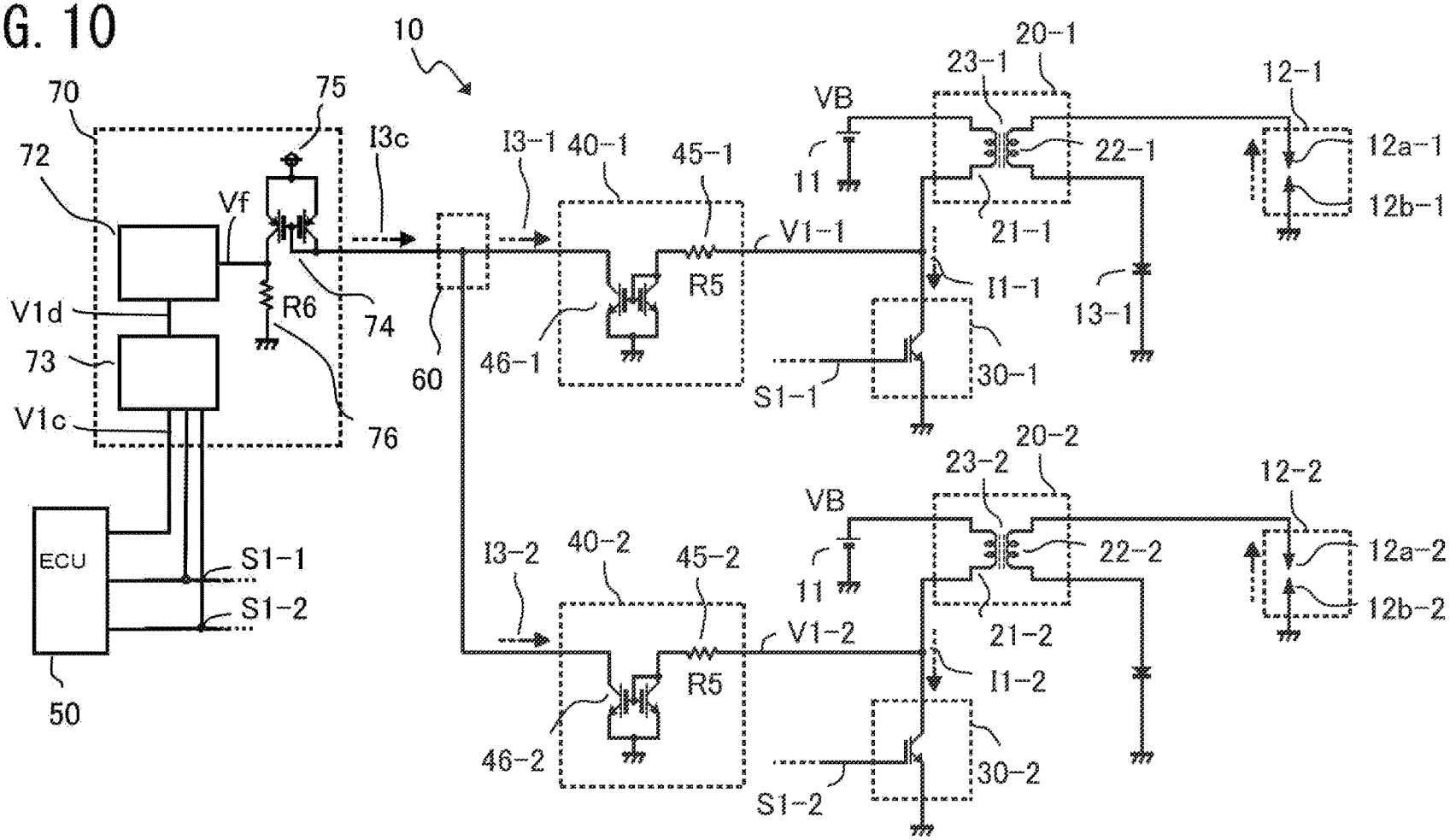
FIG. 10 is a configuration diagram showing an ignition apparatus according to Embodiment 5.

FIG. 10 is a configuration diagram showing an ignition apparatus for an internal combustion engine, according to Embodiment 5. For the configuration elements that are the same as the configuration elements shown in FIG. 1, the same numerals are given, so that detailed description thereof will be omitted.

As shown in FIG. 10, the configuration is the same as that of Embodiment 1 except for the primary-voltage-signal separators 40-1, 40-2 and the primary-voltage-information detector 70.

The primary-voltage-signal separators 40-1, 40-2 in Embodiment 5 are voltage-to-current conversion circuits which convert the primary voltages V1-1, V1-2 into current signals, to thereby output the information of the primary voltages V1-1, V1-2 for the respective cylinders, as current signals I3-1, I3-2. In Embodiment 5, an example of the primary-voltage-signal separators 40-1, 40-2, they are configured with: current conversion resistances 45-1, 45-2 for converting the primary voltages V1-1, V1-2 into current-value information; and cylinder-side current mirror circuits 46-1, 46-2 for duplicating the current-value information and outputting it from these units Because the primary signal according to the primary voltage is thus transmitted as a current, it is possible to improve the external noise immunity. A voltage signal, which is relatively high in impedance, is easily distorted by an external noise, whereas a current signal is less likely to be distorted thereby. With respect, in particular, to an ignition apparatus with strong ignition noise, improvement is noise immunity of the signal is of great significance.

In the following, the configuration elements related to the first cylinder will be described as representatives. One end of the current conversion resistance 45-1 is connected to the low-voltage side terminal of the primary coil 21-1. The other end of the current conversion resistance 45-1 is connected to the input side of the cylinder-side current mirror 46-1. The output end of the cylinder-side current mirror 46-1 is connected to the primary-signal combiner 60.

In the primary signal combiner 60, the current signals I3-1, I3-2 for the respective cylinders are electrically joined together, to form a composite primary signal (current) I3*c*.

The primary-voltage-information detector 70 includes a primary-voltage converter 72, a primary-voltage corrector 73, a detection-side current mirror 74, an internal power supply 75 and a current detection resistance 76. The input end of the detection-side current mirror 74 is connected to the primary-signal combiner 60. One end of the current detection resistance 76 is connected to the output end of the detection-side current mirror 74 and the primary-voltage converter 72. The other end the current detection resistance 76 is connected to the ground.

The primary voltage converter 72 reads out the detection voltage Vf generated the current detection resistance 76 and then performs calculation, to thereby output information of the primary voltage V1-1, as primary voltage information V1*d*, to the controller 50.

For example, the relationship between the primary voltage information Vid of the primary-voltage converter 72 and the detection voltage Vf is represented by a following formula.

$$V1d=Vf/RR2$$

Here, RR2 is calculated by a flowing formula.

$$RR2=R6/R5$$

Here, R5, denotes a value of each of the current conversion resistances 45-1, 45-2 for the respective cylinders, and R6 is a resistance value of the current detection resistance 76. In Embodiment 5, for simplification's sake, the resistance values of the current conversion resistance 45-1 for the first cylinder and the current conversion resistance 45-2 for the second cylinder are assumed to be the same.

Even during a non-operation period of coil for each of the cylinders, current information due to the power supply voltage VB is outputted as the current signal I3-1, I3-2 of each of the cylinders. Thus, when the number of the cylinders in an internal combustion engine is large, a rise in signal level of the composite primary signal (current) I3*c* of the primary-signal combiner 60 becomes large, and this cannot be ignored.

For example, when the number of current non-application coils is N for an internal combustion engine, the composite primary signal (current) I3*c* at the primary-voltage combining point during the non-operation period of these coils, is calculated by a following formula. Thus, to the extent influenced by that current, the signal of the primary voltage information V1*d* will be biased.

$$I3c=N\times VB/R5$$

In Embodiment 5, like in Embodiment 4, the primary-voltage corrector 73 is added in the primary-voltage-information detector 70, to thereby ensure functions equivalent to those in Embodiment 1 in which the primary-voltage-signal controllers 42-1, 42-2 and the signal switching devices 43-1, 43-2 are included.

More specifically, during the non-operation period of coil for each of the cylinders, the primary-voltage corrector 73 corrects the primary voltage information Vid by a primary-voltage correction amount ΔV1*c*, and primary voltage information V1*c* after correction is outputted from the primary-voltage corrector 73.

For example, when the number of current non-application coils is N for an internal combustion engine, the primary-voltage correction amount ΔV1*c* is calculated by a following formula.

$$\Delta V1c=N\times VB$$

The primary voltage information Vic after correction is calculated by a following formula.

$$V1c=V1d-\Delta V1c$$

In Embodiment 5, VCE under the application of current to the coil is smaller than the power supply voltage VB, so that, for the cylinder corresponding to the coil under the application of current, VCE is assumed to be zero for simplification's sake, and thus no correction is made about the effect thereof; however, order to calculate the correction amount more accurately, it is appropriate to add VCE under the application of current to the coil,
in the correction amount.

In Embodiment 5, the primary-voltage-signal separators 40-1, 40-2 corresponding to the respective cylinders, output the primary voltages V1-1, V1-2 as current-value information, so that the primary voltage information V1*c* after correction is represented by such a simple formula of subtracting from the primary voltage oration V1*d*, voltage resulting from multiplying the power supply voltage VB by the number of current non-application coils.

In the foregoing, the description has been made about the configuration elements related to the first cylinder; however, since the configuration elements related to the second cylinder are similar to the above, description thereof will be omitted.

<Description of Operation of Ignition Apparatus>

Figure 11:
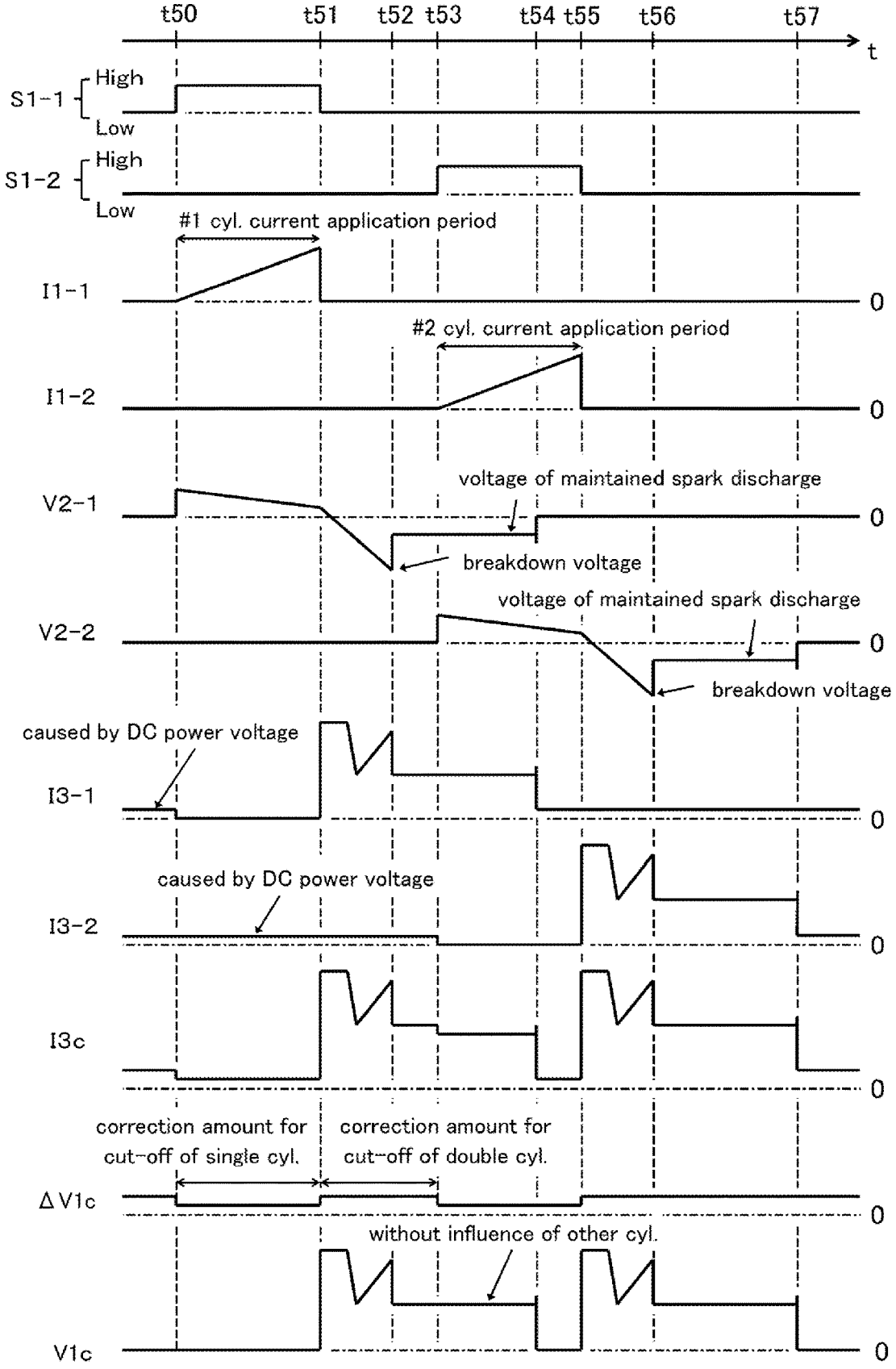
FIG. 11 is a timing chart for illustrating operations of the ignition apparatus according to Embodiment 5.

FIG. 11 is a timing chart for illustrating operations of an ignition apparatus 10 according to Embodiment 5 Upon reaching a specially-determined ignition period, the controller 50 switches, at a time t50, the command signal S1-1 for the switching device 30-1 from Low level to High level. Accordingly, a state about the application of current to the primary coil 21-1 is switched from OFF state to ON state, thus causing the primary current I1-1 to begin flowing through the primary coil 21-1. Then, magnetic energy is stored in the core 23-1. On this occasion, the primary voltage V1-1 decreases from the power supply voltage outputted by the DC power supply 11 to a level of nearly zero.

At a subsequent time t51, the controller 50 switches the command signal S1-1 from High level to Low level. Accordingly, the state about the application of current to the primary coil 21-1 is switched from ON state to OFF state, so that the primary current I1-1 is shut off.

Until this time, the number of current non-application coils is one, so that the primary-voltage corrector 73 inputs to the controller 50, the primary voltage information V1*c* after correction which results from correcting the primary voltage information V1*d* by a primary-voltage correction amount ΔV1*c* corresponding to one cylinder.

At the time t51, a primary current shut-off noise occurs in the primary voltage V1-1, so that the voltage level is elevated abruptly.

From this time, the number of current non-application coils is two, so that the primary-voltage corrector 73 inputs to the controller 50, the primary voltage information V1*c* after correction which results from correcting the primary voltage information V1*d* by a primary-voltage correction amount ΔV1*c* corresponding to two cylinders.

Thereafter, the primary voltage shut-off noise disappears, so that such a voltage level emerges that is proportional to the generated secondary voltage V2-1.

When the secondary voltage V2-1 reaches the breakdown voltage at a time t52, a spark discharge occurs between the electrodes of the ignition plug 12-1.

At a time t53, the command signal S1-2 for the switching device 30-2 is switched from Low level to High level. Accordingly, a state about the application of current to the primary coil 21-2 is switched from OFF state to ON state, thus causing the primary current I1-2 to begin flowing through the primary coil 21-2. Then, magnetic energy is stored in the core 23-2.

On this occasion, the primary voltage V1-2 decreases from the power supply voltage of the DC power supply 11 to a level of nearly zero.

From this time, the number of current non-application coils is one, so that the primary-voltage corrector 73 inputs to the controller 50, the primary voltage information V1*c* after correction which results from correcting the primary voltage information V1*d* by a primary-voltage correction amount ΔV1*c* corresponding to one cylinder.

At a time t54, the magnetic energy stored in the ignition coil 20-1 is all consumed, so that the secondary current becomes zero, resulting in termination of the spark discharge. On this occasion, the primary voltage V1-1 decreases from the voltage level during the spark discharge being maintained, to the power supply voltage outputted by the DC power supply 11.

At a subsequent time t55, the controller 50 switches the command signal S1-2 from High level to Low level. Accordingly, the state about the application of current to the primary coil 21-2 is switched from ON state to OFF state, so that the primary current I1-2 is shut off.

At the time t55, a primary current shut-off noise occurs in the primary voltage V1-2, so that the voltage level is elevated abruptly.

From this time, the number of current non-application coils is two, so that the primary-voltage corrector 73 inputs to the controller 50, the primary voltage information V1*c* after correction which results from correcting the primary voltage information V1*d* by a primary-voltage correction amount ΔV1*c* corresponding to two cylinders.

Thereafter, the primary voltage shut-off noise disappears, so that such a voltage level emerges that is proportional to the generated secondary voltage V2-2.

When the secondary voltage V2-2 reaches the breakdown voltage at a time t56, a spark discharge occurs between the electrodes of the ignition plug 12-2.

At a time t57, the magnetic energy stored in the ignition coil 20-2 is all consumed, so that the secondary current becomes zero, resulting in termination of the spark discharge.

As described above, according to Embodiment 5, the primary-voltage corrector 73 is added in the primary-voltage-information detector 70, so that the detection accuracy of the primary voltages V1-1, V1-2 becomes equivalent to that according to Embodiment 1 in which the primary-voltage-signal controllers 42-1, 42-2 and the signal switching devices 43-1, 43-2 are included.

In this manner, the ignition apparatus 10 according to Embodiment 5 can reduce, in an internal combustion engine having multiple cylinders, the required numbers of the connector pins and the A/D converters to be connected to the ECU, without degrading the detection accuracy of the nary voltages outputted by the ignition coils for the respective cylinders. This can contribute to reduction in size, weight or cost of the ignition apparatus.

In the foregoing, Embodiments 1 to 5 have been described. Following techniques may be applied to these Embodiments.

For example, in order get further reduction in size, weight or cost of the ignition apparatus for an internal combustion engine, correction processing by the primary-voltage corrector 73 may be performed in the controller 50. Further, all or a part of the primary-voltage-information detector 70 and the primary-voltage-signal separators 40-1, 40-2, may be built in the controller 50. Further, the primary-voltage-signal separator 40-1, 40-2 may be incorporated in the switching device 30-1, 30-2 so as to be constituted as an integrated switching IC, or may be disposed inside a resin mold in which the ignition coil 20-1, 20-2 is disposed.

Further, it allowed not to combine the primary voltage signals for all of the cylinders in one primary voltage signal combiner 60, namely, it is a lowed to provide multiple primary-volt age signal combiners 60 and multiple primary-voltage-information detectors 70. For example, in the case of an internal combustion engine having 8 cylinders, it is allowed to provide two sets of the primary-voltage signal combiners 60 and the primary-voltage-information detectors 70, to thereby perform primary-voltage detection for every four cylinders.

In this application, a variety of exemplary embodiments and examples are described; however, every characteristic, configuration or function that is described in one or more embodiments, is not limited to being applied to a specific embodiment, and may be applied singularly in any of various combinations thereof to another embodiment. Accordingly, an infinite number of modified examples that are not exemplified here are supposed within the technical scope disclosed in the present description. For example, such cases shall be included where at least one configuration element is modified; where any configuration element is added or omitted; and furthermore, where at least one configuration element is extracted and combined with a configuration element of another embodiment.

What is claimed is:

1. An ignition apparatus, comprising:

ignition plugs provided for multiple cylinders of an internal combustion engine, respectively;

ignition coils provided for the cylinders, respectively, wherein each of the ignition coils have a primary coil and a secondary coil that is magnetically coupled to the primary coil and connected to corresponding one of the ignition plugs;

switches provided for the cylinders, respectively, to switch between a current application state in which current is supplied to the primary coil, and a current shut-off state in which current supply to the primary coil is shut off;

primary-voltage-signal separators provided for the cylinders, respectively, for inputting thereto a voltage of the primary coil and outputting the voltage as a primary signal, wherein each of the primary-voltage-signal separators comprises a high-voltage side resistor and corresponding one of the switches;

a primary-voltage-information detector comprising a low-voltage side resistor, and a voltage converter that reads out a detection voltage divided by the high-voltage side resistor and the low-voltage side resistor, as primary voltage information of corresponding one of the cylinders; and a circuit junction to which the low-voltage side resistor of the primary-voltage-information detector is connected, and the high-voltage side resistor of each of the primary-voltage-signal separators is connected via the switches when the switches are in the current application state.

2. The ignition apparatus of claim 1, wherein, during a period where the voltage of the primary coil exceeds a predetermined primary-voltage threshold value, the primary-voltage-signal separators output the primary signal to the circuit junction.

3. The ignition apparatus of claim 2, comprising a DC power supply connected to the primary coil;

wherein, in the primary-voltage-signal separators, the predetermined primary-voltage threshold value is set more than a voltage of the DC power supply.

4. The ignition apparatus of claim 1, wherein, during a predetermined primary-voltage detection period after the switch being shut off, the primary-voltage-signal separators output the primary signal to the circuit junction.

5. The ignition apparatus of claim 1, wherein the primary-voltage-information detector determines a failure with respect to the cylinder whose primary voltage information detected after switching from the current application state to the current shut-off state is smaller than a predetermined shut-off-noise determination value.

6. The ignition apparatus of claim 1, wherein the primary-voltage-signal separators have the high-voltage side resistor between its input side and its output side; and wherein the primary-voltage-information detector has the low-voltage side resistor, to thereby input a composite primary signal, which is output from the circuit junction, by using a voltage-dividing resistance circuit constituted by the high-voltage side resistor and the low-voltage side resistor.

7. The ignition apparatus of claim 6, wherein, according to the primary voltage information after shutting-off of the application of current to the primary coil, the primary-voltage-information detector estimates an effect of a temperature on the voltage-dividing resistance circuit, to thereby make temperature correction on the output of the primary-voltage-information detector.

8. The ignition apparatus of claim 6, wherein the primary-voltage-information detector detects a failure of the voltage-dividing resistance circuit, from the primary voltage information when the primary voltage is restricted by a voltage clamp function of the switches.

9. The ignition apparatus of claim 1, wherein at least a part of configuration elements of the primary-voltage-information detector is provided inside a controller for controlling the internal combustion engine.

10. The ignition apparatus of claim 1, wherein at least a part of configuration elements of each of the primary-voltage-signal separators is disposed inside a resin mold in which corresponding one of the ignition coils is disposed.

11. The ignition apparatus of claim 1, wherein at least a part of configuration elements of each of the primary-voltage-signal separators is constituted as a switching integrated circuit (IC) that is integrated with corresponding one of the switches.

* * * * *